US005397246A

United States Patent [19]

Defibaugh et al.

[11] Patent Number: 5,397,246

[45] Date of Patent: Mar. 14, 1995

[54] PULL-TO-RELEASE IN-PLANE LATCH FOR ELECTRICAL CONNECTORS

[75] Inventors: George R. Defibaugh, Mechanicsburg; Benjamin H. Mosser, III; Robert N. Whiteman, Jr., both of Middletown, all of Pa.

[73] Assignee: The Whitaker Corporation, Wilmington, Del.

[21] Appl. No.: 167,422

[22] Filed: Jun. 3, 1993

Related U.S. Application Data

[63] Continuation of Ser. No. 831,254, Jan. 24, 1992, abandoned.

[51] Int. Cl.[6] ..... H01R 13/627

[52] U.S. Cl. ..... 439/352; 439/607; 439/372

[58] Field of Search ..... 439/345, 350–354, 439/357, 372, 607, 610

[56] References Cited

U.S. PATENT DOCUMENTS

| | | | |
|---|---|---|---|
| Re. 32,864 | 2/1989 | Ezure | 439/152 |
| 2,724,093 | 11/1955 | Preston | 439/352 X |
| 4,120,553 | 10/1978 | Muz . | |
| 4,367,003 | 1/1983 | Frantz . | |
| 4,568,135 | 2/1986 | Frantz . | |
| 4,838,808 | 6/1989 | Fujiura | 439/357 |
| 4,842,542 | 6/1989 | Davis | 439/357 |
| 4,880,392 | 11/1989 | Schieferly | 439/347 |
| 4,915,642 | 4/1990 | Lin et al. | 439/352 |
| 4,919,627 | 4/1990 | Cable | 439/372 X |
| 4,929,189 | 5/1990 | Sekiguchi | 439/357 X |
| 4,941,849 | 7/1990 | Fujiura | 439/610 |
| 5,011,424 | 4/1991 | Simmons | 439/352 |

FOREIGN PATENT DOCUMENTS

| | | | |
|---|---|---|---|
| 1048230 | 11/1966 | United Kingdom | 439/357 |

*Primary Examiner*—Khiem Nguyen

[57] ABSTRACT

An electrical connector (20) having a housing member has a latch (28 or 30) pivotably secured to the housing. The latch (28 or 30) has a latch arm (102) defining a plane and a cam arm (106). The latch (28 or 30) is pivotably actuable in the plane of the latch arm (102) upon applying a force to the cam arm (106) to rotate the latch (28 or 30) from a latched first position to an unlatched second position. The force is applied by moving a boot (38) axially along the connector housing through a limited distance from a forward position to a rearward position. Upon removal of the force from the cam arm (102), the cam arm (102) will return from the second position to the lower energy state of the first position due to the action of a spring (98). In returning to the first position, the cam arm (102) returns the boot to a forward position.

20 Claims, 9 Drawing Sheets

PULL-TO-RELEASE IN-PLANE LATCH FOR ELECTRICAL CONNECTORS

This application is a Continuation of application Ser. No. 07/831,254, filed Jan. 24, 1992, now abandoned.

BACKGROUND OF THE INVENTION

This invention relates to a latch mechanism for a connector, and in particular to a pull-to-release space saving latch mechanism that operates substantially in its own plane.

Latch mechanisms for securing connectors in a mated position have typically been pivotally secured to a connector at a mid-point providing a squeeze-to-release latch function. A rearward portion of the latch mechanism is movable toward the connector on which it is mounted to release a mated latched connector while concomitantly a forward portion having latch shoulders thereon is movable away from the connector on which it is mounted to release a mated, latch connector. Usually there are two such latch mechanisms on opposite sides of a connector such that squeezing the rearward portions is conveniently achieved using a single hand to release the mated, latched connector. Latch mechanisms of this type are disclosed in U.S. Pat. No. 4,842,542.

In some connectors the squeezing function is provided by a rearward moving portion of the connector resulting in a pull-to-release function. For instance, U.S. Pat. No. 5,011,424 discloses a connector having a pair of pivotable latch mechanisms as described above wherein an arcuately shaped portion of a boot is received in an arcuately shaped recess in the rearward portion of the latch mechanism when the connector is latched to a mating connector. To unlatch the mating connector, the boot is slid rearwardly which causes the arcuately shaped portion of the boot to press on the arcuately shaped recess in the latch mechanism which in turn pivotally rotates the latch mechanism to release a latched mating connector.

U.S. Pat. No. 4,919,627 relies on a similar technique wherein pressure ribs cause latch mechanisms to pivot toward and away from a connector.

U.S. Pat. No. 4,838,808 relies on an operating member to pivotally actuate latch members to rotate toward and away from the connector on which they are mounted. Other connector latch mechanisms include the slide latch disclosed in U.S. Pat. Nos. 4,915,642, 4,880,392, 4,367,003 and 4,568,135, and a pivotal latch disclosed in U.S. Pat. Nos. 4,941,849 and 4,120,553.

The latch mechanisms of the prior art require a substantial amount of space adjacent to the connector to provide the latching function as the latch mechanism pivots out of the path of the latching structure either on a mating connector or on a panel to which the mating connector is mounted. It would be desirable for a pull-to-release connector latch mechanism to function within the profile of the connector thereby obviating the need for additional space adjacent to the connector solely to accommodate the movement of the latch mechanism. The space savings afforded by such a latch mechanism would provide an opportunity to mount connectors closer together thereby providing higher density.

SUMMARY OF THE INVENTION

In accordance with the present invention, an electrical connector having a housing member has a pull-to-release latch pivotably secured to the housing. The latch has a latch arm defining a plane and a cam arm. The latch is pivotably actuable in the plane of the latch arm upon applying a force to the cam arm to rotate the latch from a latched first position to an unlatched second position. The force may be applied such as by pulling on a boot positioned over the structure on which the latch is mounted. Upon removal of the force from the cam arm, the cam arm will return from the second position to the lower energy state of the first position.

DESCRIPTION OF THE PREFERRED EMBODIMENT

Figure 1:
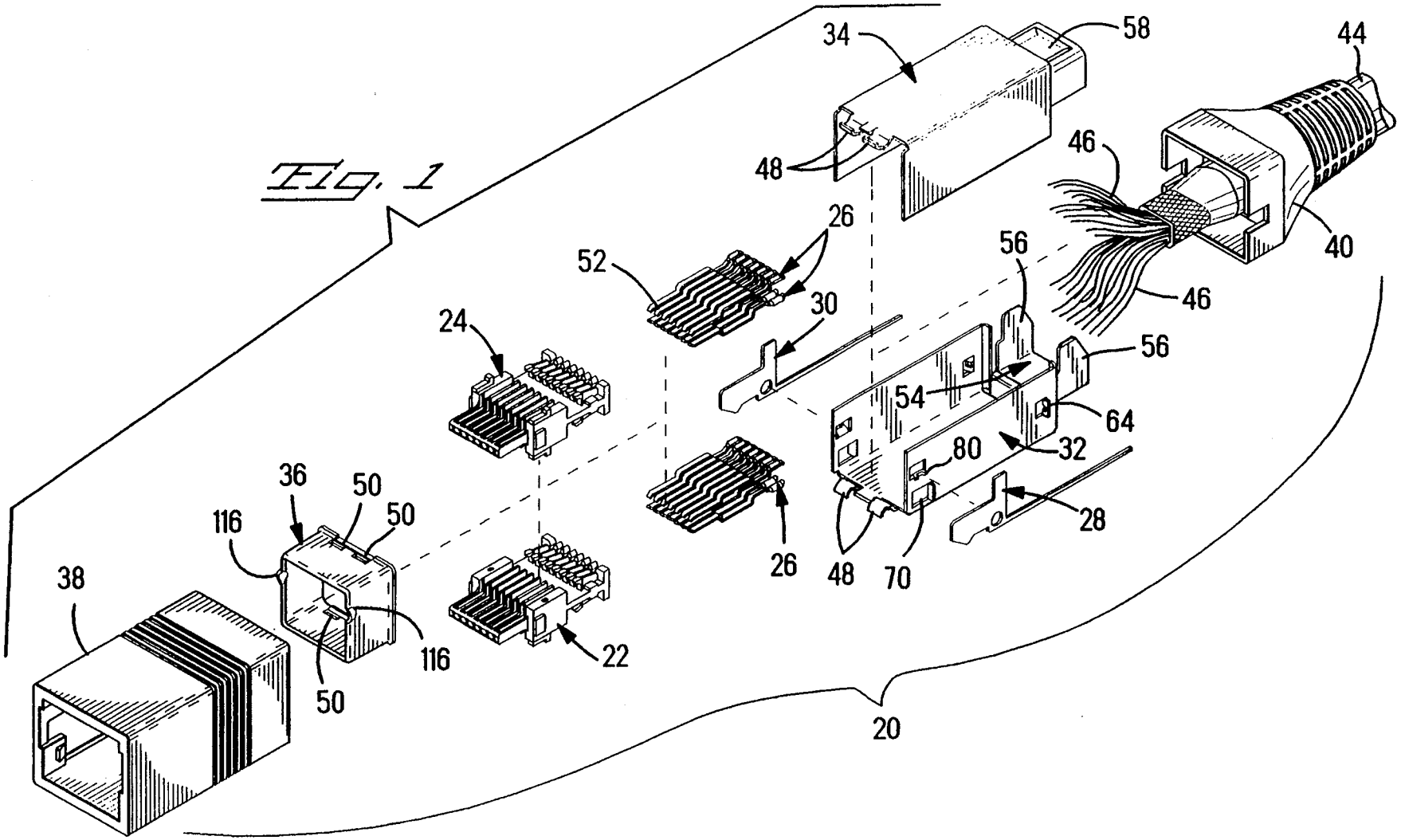
FIG. 1 is an exploded perspective view of a connector including the pull-to-release in-plane latch of the present invention.

FIG. 1 shows an exploded view of a connector 20 including the pull-to-release in-plane latch of the present invention. Connector 20 includes at least one of housing members 22,24, contacts 26 securable in a housing member and at least one latch 28,30. When connector 20 is a shielded connector, such shielding elements as lower backshell 32, upper backshell 34 and connector front shell 36 may be included. Outer boot 38 provides a latch actuation means. Inner boot 40 covers the rear portion of the lower and upper backshells at the cable egress and envelopes the cable 44 which may be shielded, the individual conductors 46 of which are terminated to respective contacts 26 in any known manner. In the preferred embodiment, conductors 46 are terminated to contacts 26 by any suitable method known in the art.

Contacts 26 are secured in housing members 22 and 24. Inner boot 38 is passed over the end of a prepared cable 46 to which the connector will be terminated; the cable does not form part of the connector. Conductors 46 are terminated through respective ones of contacts 26. Lower and upper backshells 32 and 34 are hingedly secured to front shell 36 with tabs 48 received in respective apertures 50, such as in accordance with the teaching of U.S. Pat. No. 4,585,292 or U.S. Patent application Ser. No. 766,984 filed Sep. 27, 1991, the disclosures of which are hereby incorporated by reference.

Housing members 22 and 24 are positioned in lower and upper backshells 32 and 34 with mating portions 52 of contacts 26 extending forwardly to within front shell 36. Cable 44 is positioned to exit through cable egress 54 in lower and upper backshells 32 and 34. As lower and upper backshells 32 and 34 are hingedly pivoted toward each other, sidewalls of one of the backshells will typically be received between or inside sidewalls of the other backshell. In the preferred embodiment, the sidewalls of the upper backshell 34 are received between the sidewalls of lower backshell 32. Alternatively, the sidewalls could alternate if the backshells were hermaphroditic or the edges of the backshells could abut as disclosed in U.S. Pat. No. 4,689,723, the disclosure of which is hereby incorporated by reference.

Tabs 56 of lower backshell 32 are crimped into recess 58 on upper backshell 34 to secure the two backshells together with the cable 44, including cable shielding if present, clamped securely therebetween, as taught by U.S. Patent application Ser. No. 662,587 filed Feb. 28, 1991, the disclosure of which is hereby incorporated by reference.

Figure 2:
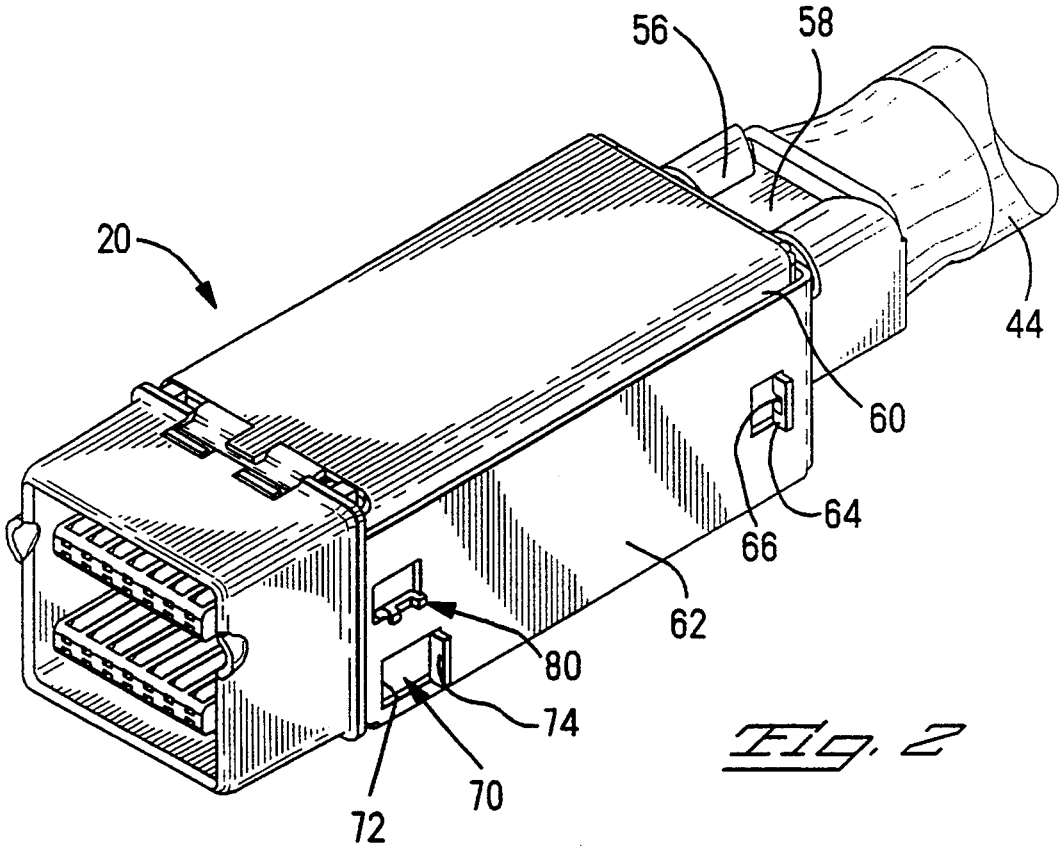
FIG. 2 is a side perspective view of a connector with the boots removed, showing upper and lower connector back shields secured to a connector shell.
Figure 3:
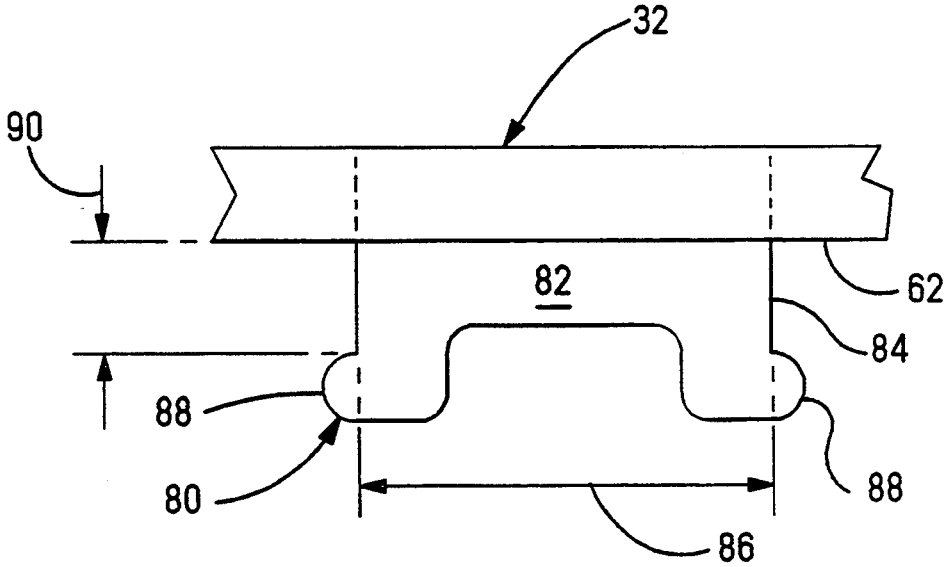
FIG. 3 is an enlarged top view of the portion of the hinge means shown in FIG. 2.

As best seen in the partial side perspective view of FIG. 2, sidewall 60 of upper shell 34 is received inside sidewall 62 of lower shell 32. Near the rear of sidewall 62 a latch spring retention member 64, comprising a portion of sidewall 62, is formed outwardly to be normal to sidewall 62. Retention member 64 has a spring receiving aperture 66 therein sized to receive a spring portion of latch 28 or 30.

A boot slide position limit aperture 70 is also formed in sidewall 62. Aperture 70 defines rearward facing forward stop surface 72 and forward facing rearward stop surface 74. Rearward stop surface 74, in the preferred embodiment, is formed by displacing a portion of sidewall 62 outwardly normal to sidewall 62 in the process of forming aperture 70. The function of aperture 70 and stop surfaces 72,74 will be discussed in greater detail below.

Latch pivot member 80 formed in sidewall 62 is also positioned near the front shell. Latch pivot member 80, in the preferred embodiment, is stamped from sidewall 62 then formed outwardly to be normal thereto. Latch pivot member 80 has a base 82 providing a pivot section 84 cooperable with an aperture on the latch having a diameter slightly greater than dimension 86 to permit the latch to rotate thereabout. Two spaced arcuate latch retention members 88 extend base 82 beyond the distance 86 to provide a distance 90 between sidewall 62 and the latch retention members. Distance 90 is slightly greater than the thickness of latch 28 or 30. The latch retention members provide retention for a latch once it is positioned on latch pivot member 80.

Figure 4:
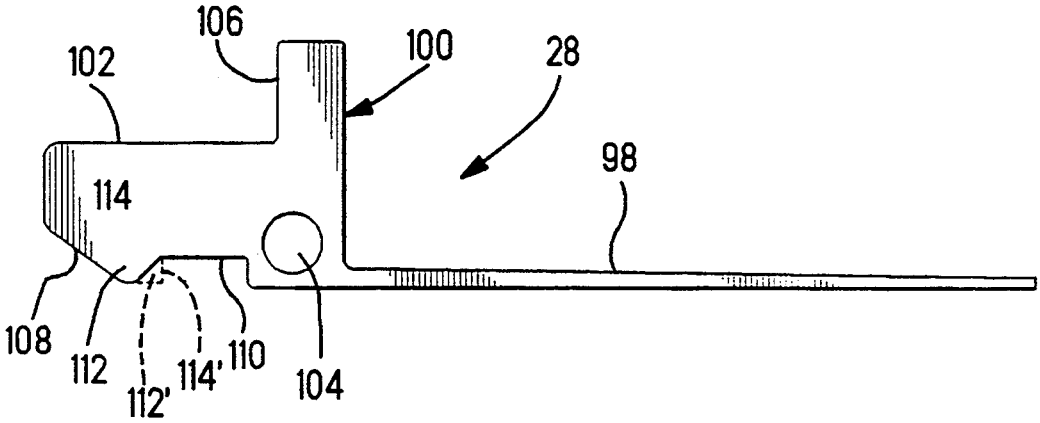
FIG. 4 is a side view of the latch.
Figure 5:
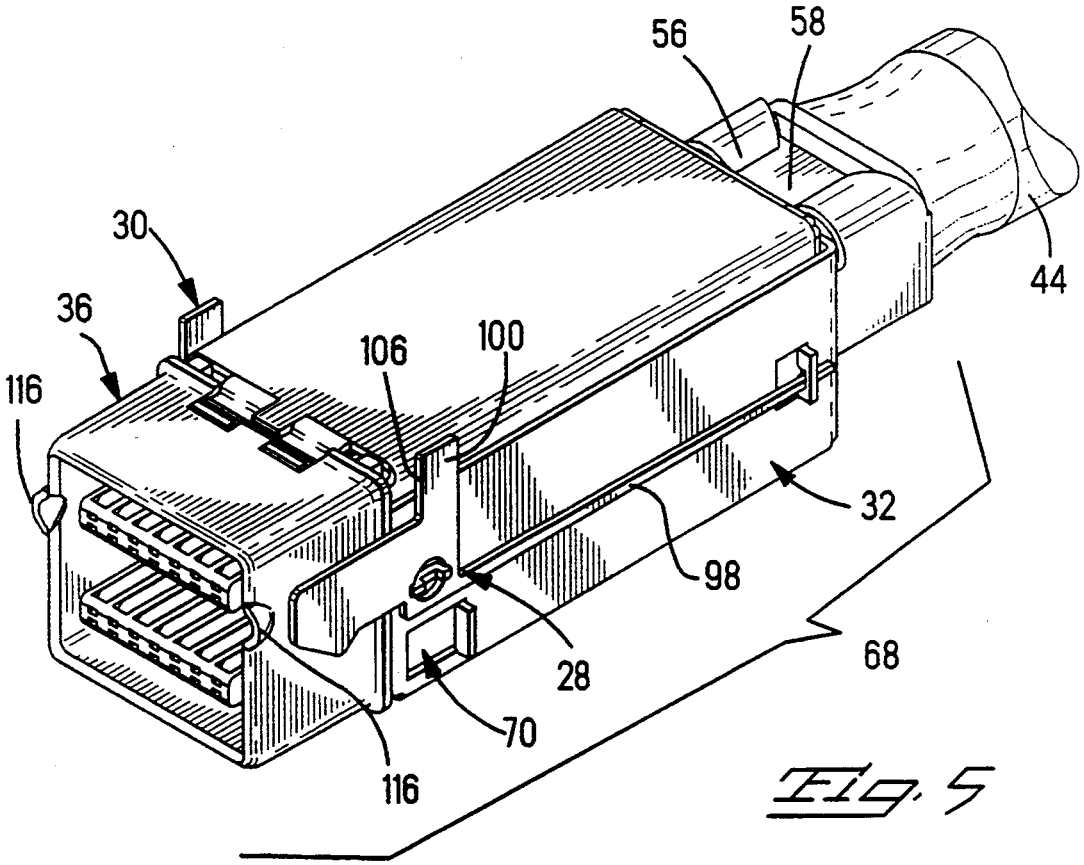
FIG. 5 is a perspective view of the connector with the boots removed as in FIG. 2, with the latch pivotally mounted on a shield.

Latches 28 and 30 are identical and therefore only one will be described in detail. A side view of latch 28 is shown in FIG. 4 and a perspective view, mounted on a lower backshell 32, is shown in FIG. 5. Latch 28 in the preferred embodiment is stamped from steel, but other materials and methods of formation are within the scope of the invention. Latch 28 has a rearwardly extending spring member 98, an upwardly extending cam arm 100, a forwardly extending latch arm 102 and a central aperture 104. The distal end of spring member 98 is receivable in aperture 66 of spring retention member 64 as best seen in FIG. 5. In a preferred embodiment, spring member 98 is in the same plane as latch arm 102. The distal end of spring member 98, in the preferred embodiment, is slidable within aperture 66.

Cam arm 100 provides a forwardly facing cam surface 106 the function of which will be described below.

Latch arm 102 extends forwardly along side and spaced from front shell 36. Extending downwardly and rearwardly from the forward end is a lead-in surface 108 extending from above the plane of latch limit surface 110 to a latch protrusion 112 which extends below latch limit surface 110. The rear surface 114 of latch protrusion 112 can take on any angle from an acute angle (FIG. 4) relative to surface 110 which provides a reverse angle as shown in phantom in FIG. 4, to being perpendicular to surface 110, to an oblique angle with respect to surface 110 as shown in FIGS. 4 and 5. The angle of rear surface 114 can be varied to achieve a desired threshold retention force such that when the cable 44 is pulled with a force up to the threshold, connector 20 will remain latched, however, when the force exceeds the thrush hold the latch will yield and connector will be unlatched.

Front shell 36 may have laterally extending polarization protrusions 116 forward of latch arm 102, as best seen in FIG. 5. Polarization protrusions 116 extend laterally beyond front shell 36 to prevent connector 20 from being receivable in aperture 122 upside down. Polarization protrusions 116 thus assure that connector 20 is oriented correctly before passing through aperture 122 for mating with connector 118. In this manner, the polarization protrusions protect the latch arms 102 by preventing a condition in which the latch arms could engage or stub against the panel if connector were not properly oriented for reception in aperture 122.

Figure 6:
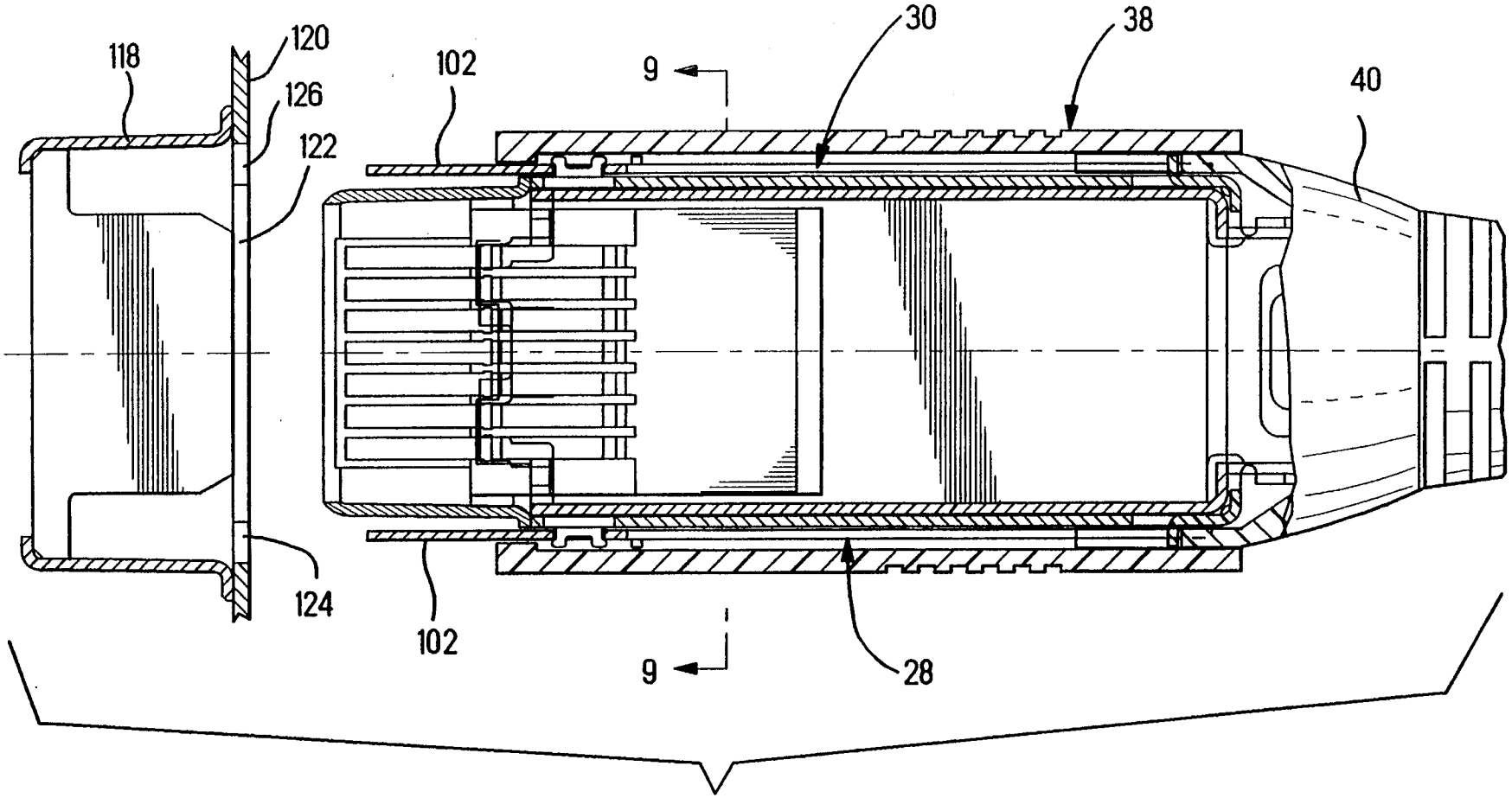
FIG. 6 is a top sectional view of a connector including the in-plane latch showing latches on opposite sides of the connector with the connector aligned to mate through a panel with a mating connector.

FIG. 6 shows a top sectional view of a connector 20 having a pair of latches 28,30. Latches 28 and 30 function independently of each other. Latches 28 and 30 may be actuated by a common actuation mechanism, such as outer boot 38.

Connector 20 is aligned to be mated with a complimentary connector 118 through panel 120 and aperture 122 therein. Complimentary connector 118 is mounted on panel 120 having aperture 122 to receive a forward portion of connector 20, such as front shell 36, and latch engaging surfaces 124,126.

Figure 7:
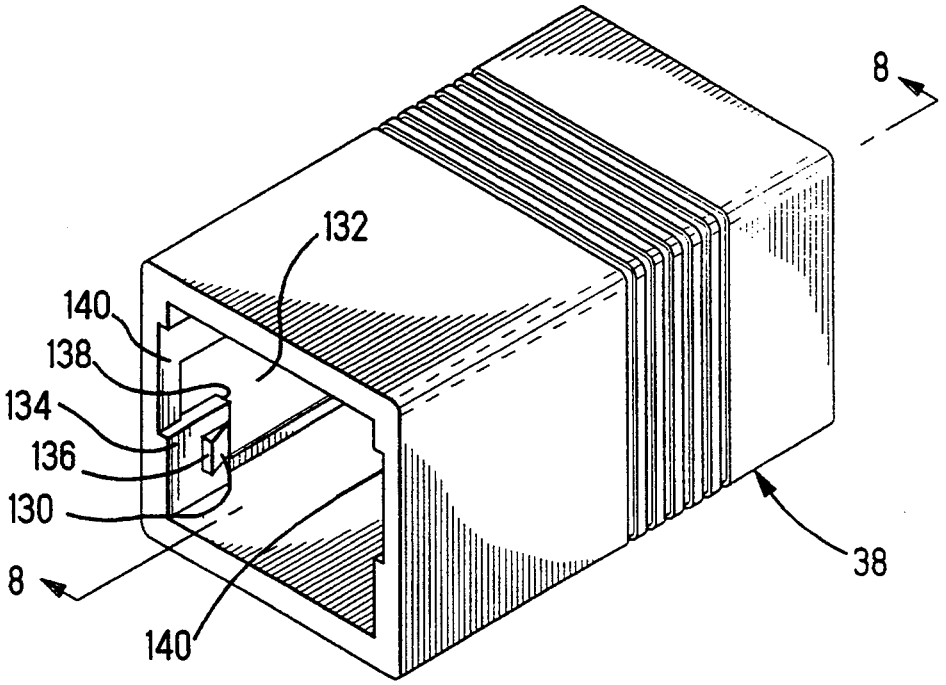
FIG. 7 is a perspective view of a boot to be positioned over the upper and lower connector shields.
Figure 8:
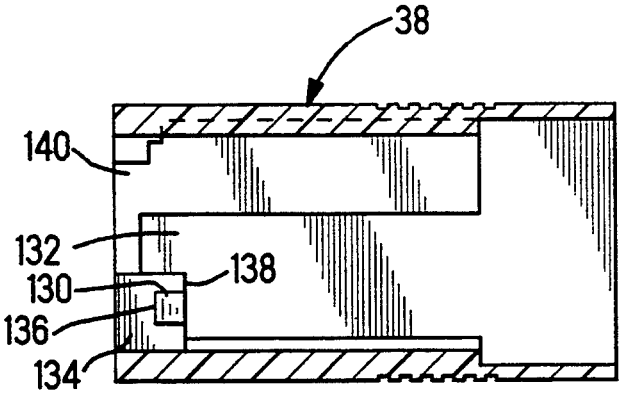
FIG. 8 is a cross sectional view of the boot taken along the line 8—8 in FIG. 7, with the connector housing and contacts removed for clarity.

As best seen in FIGS. 7 and 8, outer boot 38 includes a tapered stop 130 extending inwardly from mirror image opposed inside walls 132. Tapered stop 130 extends toward the opposed inside wall from surface 134 thereby defining a forward facing forward stop surface 136. At the rear of tapered stop 130 where stop 130 blends into surface 134, an offset in the inside wall 32 forms a rearward facing rearward stop surface 138. Channels 140 accommodate latch arms 102 and the pivoting motion thereof.

Figure 9:
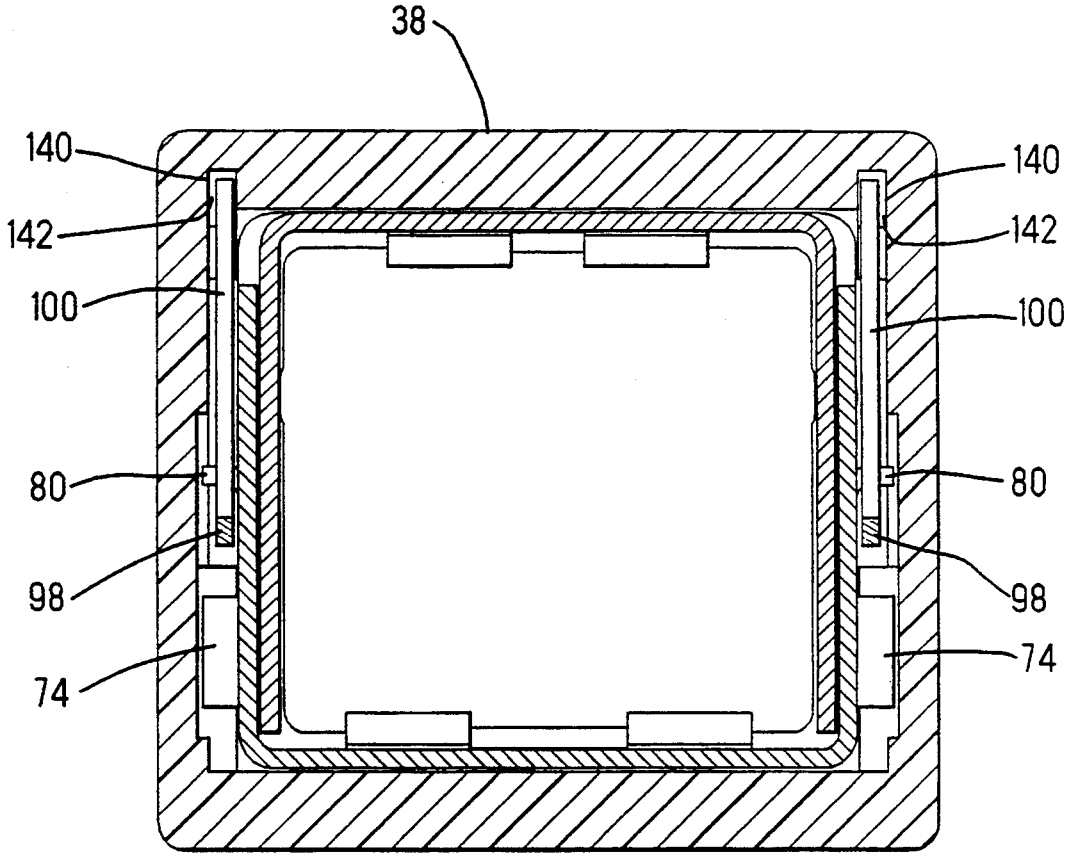
FIG. 9 is a cross sectional view of the connector taken at the lines 9—9 in FIG. 6.
Figure 10:
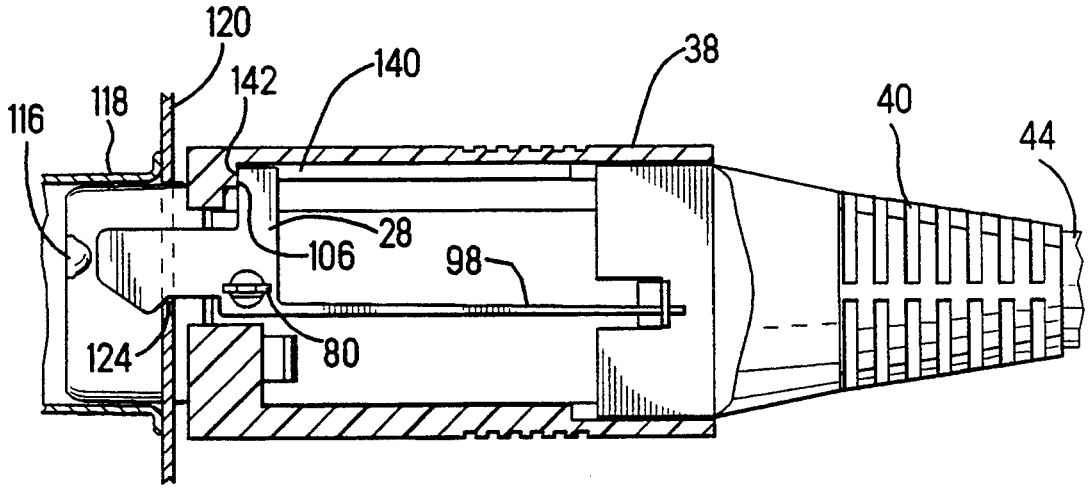
FIG. 10 is a side view, showing the forward boot positioned over the connector shields with the boot positioned to actuated the latch.

As best seen in FIGS. 8, 9 and 10, the distal end of cam arm 100 is received in a channel 140 on the inside upper surface of outer boot 38. The forward end of channel 140 terminates in a rearward facing surface 142 that engages cam surface 106 when outer boot 38 is positioned over the subassembly shown in FIG. 5.

Connector 20 is assembled in the manner described above. In the assembly process, the sidewalls of outer boot 38 expand outwardly as outer boot 38 approaches the final position on the assembly shown in FIG. 6 until tapered stop 130 is received in boot slide position limit aperture 70, whereupon the sidewalls of outer boot 38 resile inwardly. Inner boot 40 may be pushed forward along cable 44 and secured in position in any known manner either after or, preferably, before outer boot 38 is positioned over the subassembly shown in FIG. 5.

FIG. 10 shows a connector 20, partly in cross section, terminated to conductors of a cable 44, mated with a complimentary connector 118 and latched to a panel 120. Outer boot 38 is in the forward position with rearward surface 142 engaging cam surface 106. Spring member 98 is in a de-energized state. This is the position latch 28 and boot 38 assume when connector 20 is mated with complimentary connector 118 and with connector 20 latched to panel 120, or when a connector 20 is unmated and free of panel 120.

Figure 11:
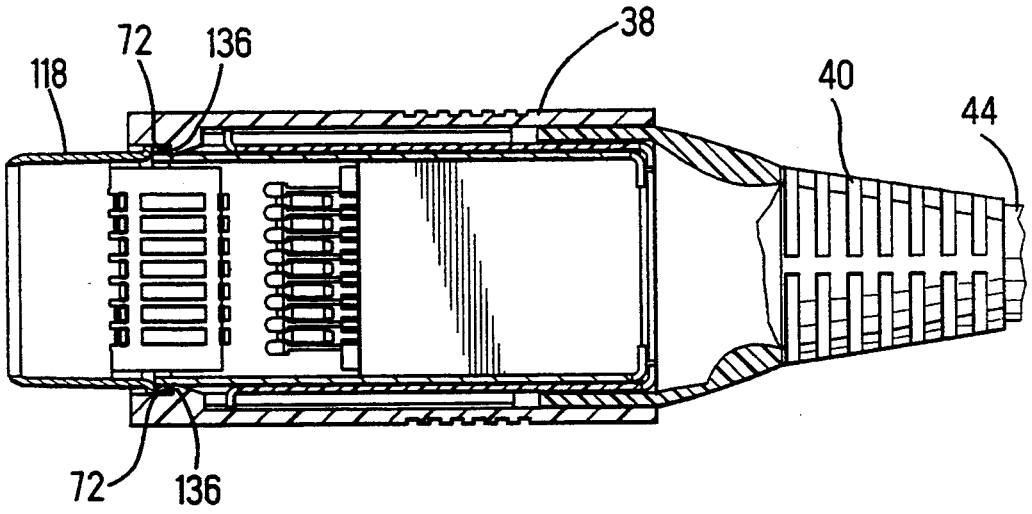
FIG. 11 is a top view, partially in section, with the boot in the same position as in FIG. 10.

FIG. 11 is a top view of connector 20, terminated to conductors of a cable, with outer boot 38 in the same position as in FIG. 10. With outer boot 38 in the forward latched or released position, forward stop surface 136 of tapered stop 130 engages stop surface 72, on both sides of connector 20, to secure outer boot 38 on connector 20 and to prevent outer boot 38 from sliding off of the subassembly shown in FIG. 5.

Figure 12:
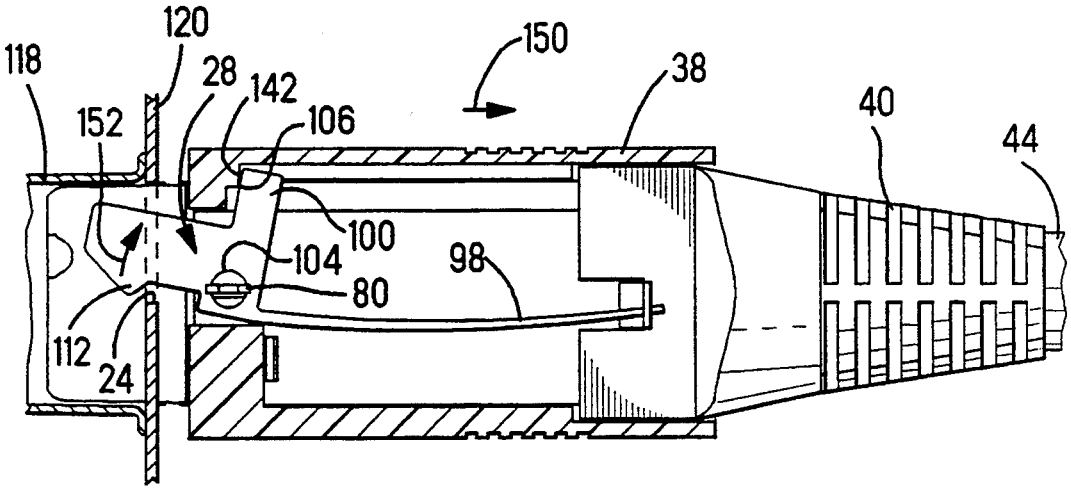
FIG. 12 is a side view, partially in section, showing the boot shifted rearward to actuate the latch.
Figure 13:
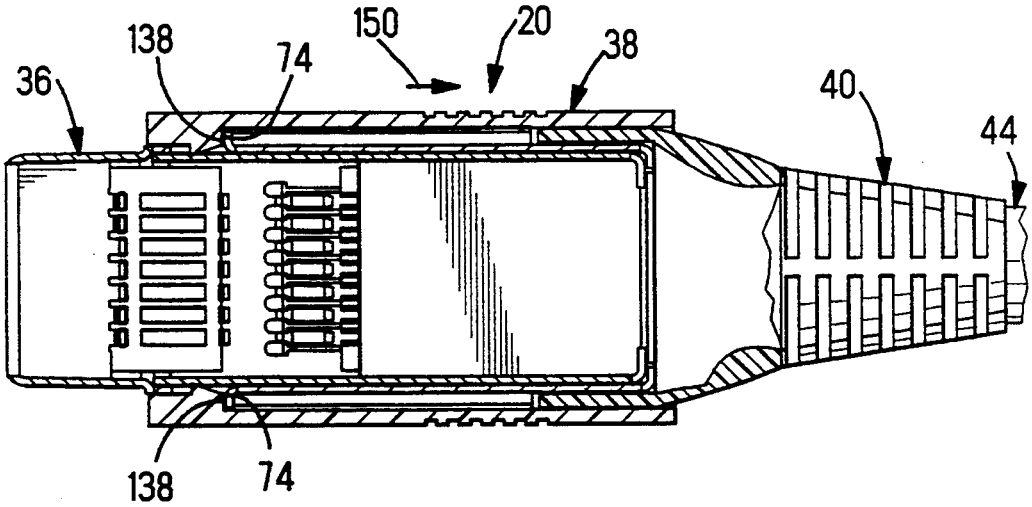
FIG. 13 is a top view, partially in section, with the boot in the same position as in FIG. 12.

As depicted in FIGS. 12 and 13, outer boot 38 has been moved or pulled rearward as indicated by arrow 150. In moving rearward, outer boot 38 moves axially along sub-assembly 68, or connector 20, through a limited distance, away from the mating face of connector 20. Outer boot 38 is utilized as a latch actuation during a pull-to-release operation and also may be used prior to mating connectors 20 and 118 to pivot latch arm 102 clear of panel 120. As boot 38 is slid rearward over subassembly 68, surface 142 presses on cam surface 106 causing cam arm 100 and latch arm 102 to rotate about pivot aperture 104 and latch pivot member 80 clockwise (as shown in FIG. 12) as indicated by arrow 152. Due to the rotation of a portion of latch 28, spring member 98 is energized or biased. In addition, latch limit surface 110 and latch protrusion 112 are rotated away from respective latch engaging surfaces 124 or 126. The distal end of latch protrusion 124 rotates to a position above latch engaging surfaces 124 or 126 so that connector 20 can be unmated from complimentary connector 118.

As best seen in FIG. 13, the travel of inner boot 38 is limited. With inner boot 38 in the rearmost position, rearward stop surface 138 engages rearward stop surface 74 limiting the rearward movement of boot 38.

When inner boot 38 is released from the position shown in FIGS. 12 and 13, the energy stored in spring member 98 rotates latch arm 102 and cam arm 100, counterclockwise as shown in FIG. 12, such that latch arm 102 latches to panel 120 if proximate thereto and concomitantly causes outer boot 38 to slide forward toward the mating face of connector 20.

While outer boot 38 may be pulled rearward to pivot latch arm 102 of latches 28 and 30, and specifically latch protrusion 112, above latch engaging surfaces 124,126 as connector 20 is being mated with connector 118, similar to when the connectors are being unmated, it is not necessary. Connector 20, properly oriented, can be aligned with aperture 122 and connector 118 for mating. Connector 20 may be held by boot 38. Connector 20 is then moved toward aperture 122 and connector 118. As the leading edge of front shell 36 passes into and through aperture 122, lead-in surfaces 108 on latches 28,30 engage latch engaging surfaces 124,126 respectively. As connector 20 continues moving toward connector 118, surfaces 108 ride up, causing the latch arms and cam arms to rotate and concomitantly spring member 98 to energize, until the distal ends of respective latch protrusions 112 ride over latch engaging surfaces 124,126. Continued movement of connector 20 will permit rear surfaces 114 to ride down latch engaging surfaces 124,126 as spring member 98 releases energy and causes the latch arms and cam arms to rotate in the opposite direction. This continues until latch limit surface 110 is seated against respective latch engaging surfaces 124,126, thereby latching connector 20 to panel 120 with connectors 20 and 118 mated.

Figure 14:
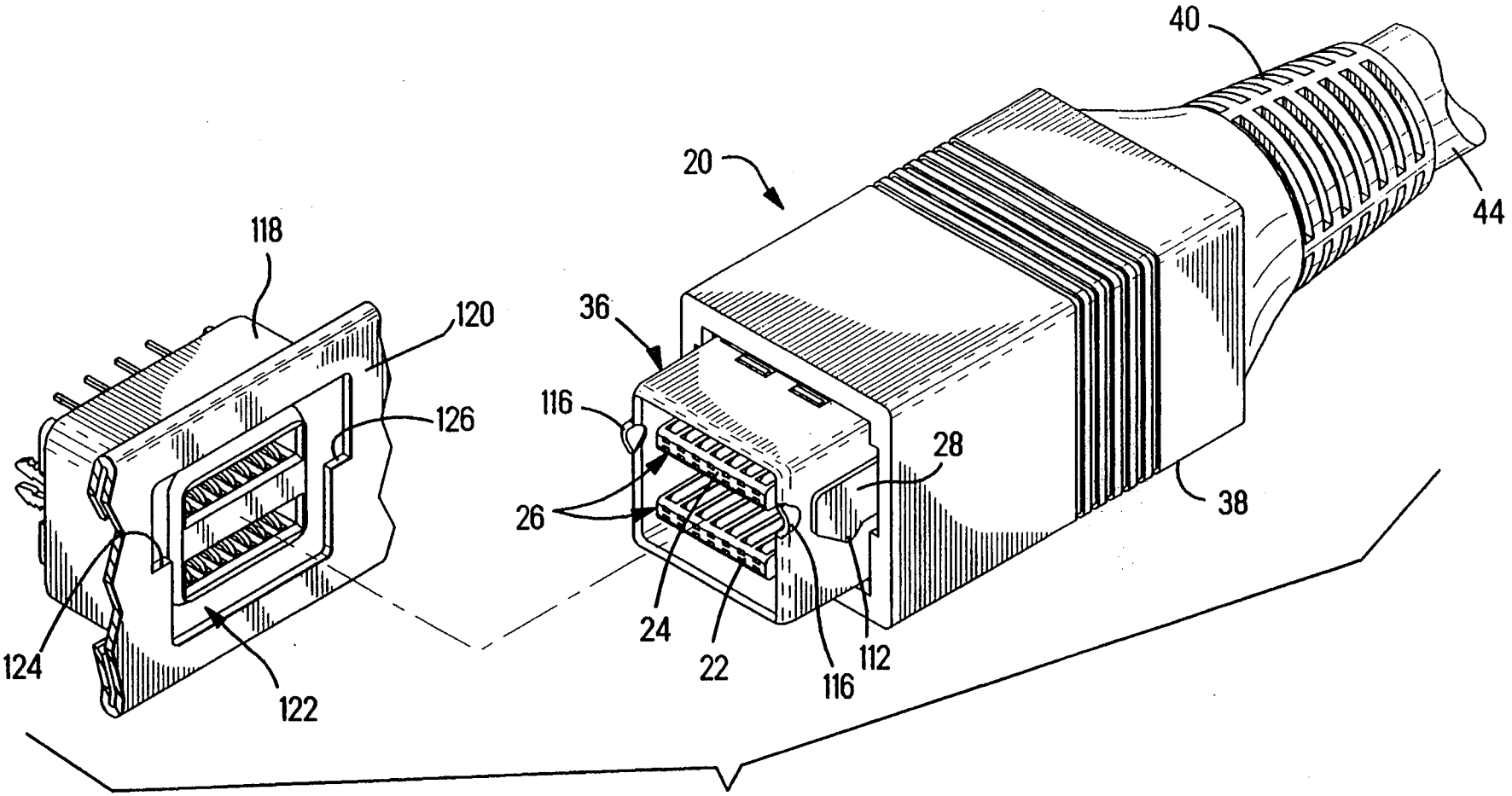
FIG. 14 is a perspective view of a connector including the pull-to-release in-plane latch, positioned to be received through a panel aperture to mate with a mating connector and to latch to the panel.

FIG. 14 shows a perspective view of connector 20 properly oriented to be received in aperture 122 to mate with complimentary connector 118 and to latch to panel 120 with connector 20 mated to connector 118.

While the preferred embodiment discloses a pull-to-release in-plane latch wherein the latch is secured to a shield member, the invention can be used with an unshielded connector. The latch could be pivotally mounted or secured on a non-shielding housing member. In addition, while the preferred embodiment discloses a pull-to-release in-plane latch that latches to a panel adjacent to which the mating connector is mounted, the latch could latch onto structure of a mating connector of appropriate design. Although the spring member is shown as having a distal end slidable in an aperture in the preferred embodiment, it is recognized that other spring configurations could have a distal end that is secured.

We claim:

1. An electrical connector, comprising: electrical contacts in at least one housing member, a shield over the housing member, an outer boot over the shield, at least one single piece latch with a unitary spring member, the latch being pivotally mounted to the shield, the boot being moveable rearwardly over the shield urging the latch pivotally to an unlatching position and biasing the unitary spring member, and the unitary spring member biasing the latch pivotally to a latching position wherein, a retention member is formed from the shield by which the unitary spring member is retained, and a distal end of the unitary spring member is received slidably in an aperture of the retention member.

2. An electrical connector as recited in claim 1, comprising: a pivot formed from the shield to which the latch is pivotally mounted, and a retention member formed from the shield by which the unitary spring member is retained.

3. An electrical connector as recited in claim 1, comprising: a forwardly located stop surface formed from the shield and engaging the boot, the boot being moveable forwardly over the shield to engage the stop surface.

4. An electrical connector as recited in claim 1, comprising: a rearwardly located stop surface formed from the shield and engaging the boot, the boot being moveable rearwardly over the shield to engage the rearwardly located stop surface.

5. An electrical connector as recited in claim 1, comprising: the latch being mounted laterally of the shield, and a laterally projecting protrusion on the shield positioned forwardly of the latch to prevent stubbing of the latch.

6. An electrical connector comprising: electrical contacts in at least one housing member, at least one single piece latch with a unitary spring member, a latch mounting member on the housing member pivotally mounting the latch, the latch being moveable pivotally to an unlatching position and biasing the unitary spring member, and the unitary spring member biasing the latch pivotally to a latching position and the mounting member is a shield over the housing member, wherein, a retention member is formed from the shield by which the unitary spring member is retained, and a distal end of the unitary spring member is received slidably in an aperture of the retention member.

7. An electrical connector as recited in claim 6, comprising: a pivot formed from the shield to which the latch is pivotally mounted, and a retention member formed from the shield by which the unitary spring member is retained.

8. An electrical connector as recited in claim 6, comprising: the latch being mounted laterally of the shield, and a laterally projecting protrusion on the shield positioned forwardly of the latch to prevent stubbing of the latch.

9. An electrical connector, comprising: electrical contacts in at least one housing member, a shield over the housing member, an outer boot over the shield, at least one single piece latch with a unitary spring member, the latch being pivotally mounted to the shield, the boot being moveable rearwardly over the shield urging the latch pivotally to an unlatching position and biasing the unitary spring member, the unitary spring member biasing the latch pivotally to a latching position, and both a pivot and a retention member formed from the shield, said pivot being by which the latch is pivotally mounted, and said retention member being by which the unitary spring member is retained.

10. An electrical connector as recited in claim 9, comprising: the latch and unitary spring member being in the same plane and the latch arm being moveable pivotally in said plane.

11. An electrical connector, comprising: electrical contacts in at least one housing member, a shield over the housing member, an outer boot over the shield, at least one single piece latch with a unitary spring member, the latch being pivotally mounted to the shield, the boot being moveable rearwardly over the shield urging the latch pivotally to an unlatching position and biasing the unitary spring member, the unitary spring member biasing the latch pivotally to a latching position, and a forwardly located stop surface formed from the shield and engaging the boot, the boot being moveable forwardly over the shield to engage the stop surface.

12. An electrical connector as recited in claim 11, comprising: the latch and unitary spring member being in the same plane and the latch and being moveable pivotally in said plane.

13. An electrical connector, comprising: electrical contacts in at least one housing member, a shield over the housing member, an outer boot over the shield, at least one single piece latch with a unitary spring member, the latch being pivotally mounted to the shield, the boot being moveable rearwardly over the shield urging the latch pivotally to an unlatching position and biasing the unitary spring member, the unitary spring member biasing the latch pivotally to a latching position, and a rearwardly located stop surface formed from the shield and engaging the boot, the boot being moveable rearwardly over the shield to engage the rearwardly located stop surface.

14. An electrical connector as recited in claim 13, comprising: the latch and unitary spring member being in the same plane and the latch arm being moveable pivotally in said plane.

15. An electrical connector, comprising: electrical contacts in at least one housing member, a shield over the housing member, an outer boot over the shield, at least one single piece latch with a unitary spring member, the latch being pivotally mounted to the shield, the boot being moveable rearwardly over the shield urging the latch pivotally to an unlatching position and biasing the unitary spring member, the unitary spring member biasing the latch pivotally to a latching position, the latch being mounted laterally of the shield, and a laterally projecting protrusion on the shield positioned forwardly of the latch to prevent stubbing of the latch.

16. An electrical connector as recited in claim 15, comprising: the latch and unitary spring member being in the same plane and the latch arm being moveable pivotally in said plane.

17. An electrical connector comprising: electrical contacts in at least one housing member, at least one single piece latch with a unitary spring member, a latch mounting member pivotally mounting the latch, the mounting member being a shield over the housing member, the latch being moveable pivotally to an unlatching position and biasing the unitary spring member, the unitary spring member biasing the latch pivotally to a latching position, and both a pivot and a retention member formed from the shield, said pivot being to which the latch is pivotally mounted, and said retention member being by which the unitary spring member is retained.

18. An electrical connector as recited in claim 17, comprising: the latch and unitary spring member being in the same plane and the latch arm being moveable pivotally in said plane.

19. An electrical connector comprising: electrical contacts in at least one housing member, at least one single piece latch with a unitary spring member, a latch mounting member pivotally mounting the latch, the mounting member being a shield over the housing member, the latch being moveable pivotally to an unlatching position and biasing the unitary .spring member, the unitary spring member biasing the latch pivotally to a latching position, the latch being mounted laterally of the shield, and a laterally projecting protrusion on the shield positioned forwardly of the latch to prevent stubbing of the latch.

20. An electrical connector as recited in claim 19, comprising: the latch and unitary spring member being in the same plane and the latch arm being moveable pivotally in said plane.

* * * * *